US009512597B2

(12) United States Patent
Van Hooft et al.

(10) Patent No.: US 9,512,597 B2
(45) Date of Patent: Dec. 6, 2016

(54) DEVICE TO ACTUATE A FLUIDCONNECTOR CONTAMINATION COVER

(75) Inventors: Cornelius Antonius Maria Van Hooft, AH Helvoirt (NL); Dirk Jacobus Luyendijk, RE Heeswijk-Dinther (NL); Holger Jongebloed, Schortens (DE)

(73) Assignee: Caterpillar Work Tools B.V., s-Hertogenbosch (NL)

( * ) Notice: Subject to any disclaimer, the term of this patent is extended or adjusted under 35 U.S.C. 154(b) by 313 days.

(21) Appl. No.: 14/343,078

(22) PCT Filed: Sep. 3, 2012

(86) PCT No.: PCT/EP2012/067091

§ 371 (c)(1),
(2), (4) Date: Mar. 6, 2014

(87) PCT Pub. No.: WO2013/034516

PCT Pub. Date: Mar. 14, 2013

(65) Prior Publication Data

US 2014/0224115 A1 Aug. 14, 2014

(30) Foreign Application Priority Data

Sep. 7, 2011 (EP) ..... 11180408

(51) Int. Cl.
*E02F 3/36* (2006.01)
*E02F 9/22* (2006.01)

(52) U.S. Cl.
CPC ..... *E02F 9/2278* (2013.01); *E02F 3/3654* (2013.01); *E02F 3/3663* (2013.01); *E02F 9/226* (2013.01); *E02F 9/2275* (2013.01)

(58) Field of Classification Search
CPC .... E02F 3/3645; E02F 3/3654; E02F 3/3663
USPC ..... 91/32
See application file for complete search history.

(56) References Cited

U.S. PATENT DOCUMENTS 2,568,254 A * 9/1951 Purcell ..... F15B 11/126 60/419
3,188,916 A * 6/1965 Beatty ..... B60T 13/261 137/496

(Continued)

FOREIGN PATENT DOCUMENTS

CN 1865605 11/2006
DE 19751292 2/1999

(Continued)

*Primary Examiner* — John K Fristoe, Jr.
*Assistant Examiner* — Matthew Wiblin

(57) ABSTRACT

A device to actuate a contamination cover on a machine bracket is disclosed. The device may include a first transition cylinder mounted on the machine bracket and connected to the contamination cover, a transition circuit connected to the first transition cylinder for transmission of hydraulic pressure to the first transition cylinder; and a transition sensor coupled to the transition circuit to control the transmission of hydraulic pressure to the first transition cylinder. The activation of the transition sensor may permit the transmission of hydraulic pressure to drive the first transition cylinder for transition of the contamination cover from a close to an open position.

15 Claims, 5 Drawing Sheets

(56) References Cited

U.S. PATENT DOCUMENTS

| | | | | | |
|---|---|---|---|---|---|
| 3,222,993 | A * | 12/1965 | Rasmussen | B64C 13/24 | 91/20 |
| 4,371,004 | A * | 2/1983 | Sysolin | E02F 3/3654 | 137/614.04 |
| 6,301,811 | B1 * | 10/2001 | Gilmore, Jr. | E02F 3/3622 | 37/468 |
| 6,899,509 | B1 * | 5/2005 | Mailleux | E02F 3/3622 | 37/468 |
| 8,684,623 | B2 * | 4/2014 | Robl | F16D 1/00 | 37/468 |
| 2010/0052312 | A1 * | 3/2010 | Martin | E02F 3/3622 | 285/45 |
| 2010/0229956 | A1 * | 9/2010 | Luyendijk | E02F 3/3654 | 137/15.01 |

FOREIGN PATENT DOCUMENTS

| | | | | |
|---|---|---|---|---|
| DE | 10159417 C2 | * | 12/2003 | E02F 3/3654 |
| DE | 202007001232 | | 3/2007 | |
| DE | 102010006692 | * | 8/2011 | E02F 3/3618 |
| EP | 1775159 | | 4/2007 | |
| WO | 9927194 | | 6/1999 | |

* cited by examiner

DEVICE TO ACTUATE A FLUIDCONNECTOR CONTAMINATION COVER

TECHNICAL FIELD

This disclosure relates to a device and a method for control of coupling components that couple a worktool to a machine, particularly to a method and a device for control of contamination covers of fluidconnectors. This disclosure also relates to a coupling arrangement for coupling a work tool to a machine.

BACKGROUND

Worktools, such as shears, grabs, or buckets may be coupled with host machines, such as excavators, to perform work operations like cutting, grabbing or excavating. The worktools may be coupled to a boom or stick mechanism of the host machine via a fixed connection or a quick release connection.

A quick release connection may allow for a relatively easy exchange of the worktool whereby the operator connects or changes a worktool without leaving the cab. The machine mounting bracket is arranged to slide into the worktool mounting bracket, when the worktool is positioned on the ground. After aligning the mounting bracket of the worktool and the mounting bracket of the machine, a locking device may be moved into a locked position to lock the worktool to the machine.

When connecting the work tool to the machine, the hydraulic hoses of the machine and work tool pressure fluid circuits may be connected for driving the work tool. Automatic hydraulic hose connection systems are known which may be activated by the operator from the cab for connection of the hydraulic hoses. Such systems may often be dependent on the connection of the work tool to the machine. Hydraulic hose couplers may be provided and arranged so that during connection of the work tool to the machine the hose couplers are also automatically connected. When the work tool mounting bracket is connected to the machine mounting bracket, the hose couplers may be contemporaneously connected.

The worktool or machine unused during a specific operation may be subject to external elements such as moisture and dust or other contaminants which may settle on the fluidconnectors of the hydraulic lines. Such contamination may damage the fluidconnectors of the worktool or the machine during a coupling procedure or may result in impeding the coupling of the machine mounting bracket and the worktool mounting bracket.

WO199927194 discloses a device for protecting connection elements on construction equipment from grime, dust and water. The connection elements may serve to connect lines for liquid and gaseous mediums or for electric cables. A covering arrangement may protect the connection elements. The covering arrangement may comprise a tubular and movable envelope provided with openings which cover or expose the connection elements through rotation of the envelope around the connection elements. The envelope may be provided on the worktool bracket or the machine bracket and may be rotated by actuation of a lever connected thereto.

The present disclosure is directed, at least in part, to improving or overcoming one or more aspects of the prior art system.

BRIEF SUMMARY OF THE INVENTION

In a first aspect, the present disclosure provides a device to actuate a contamination cover on a machine bracket, the device comprising a first transition cylinder mounted on the machine bracket and connected to the contamination cover; a transition circuit connected to the first transition cylinder for transmission of hydraulic pressure to the first transition cylinder; and a transition sensor coupled to the transition circuit to control the transmission of hydraulic pressure to the first transition cylinder, wherein the activation of the transition sensor permits the transmission of hydraulic pressure to drive the first transition cylinder for transition of the contamination cover from a close to an open position.

In a second aspect, the present disclosure provides a method of actuating a contamination cover on a machine bracket, the method comprising the steps of transmitting a hydraulic pressure to a transition circuit connected to a first transition cylinder, the first transition cylinder being mounted on the machine bracket and being connected to the contamination cover; and activating a transition sensor coupled to the transition circuit, wherein the activation of the transition sensor permits the transmission of the hydraulic pressure to drive the first transition cylinder for the transition of the contamination cover from a close to an open position.

Other features and advantages of the present disclosure will be apparent from the following description of various embodiments, when read together with the accompanying drawings.

BRIEF DESCRIPTION OF THE DRAWINGS

The foregoing and other features and advantages of the present disclosure will be more fully understood from the following description of various embodiments, when read together with the accompanying drawings, in which.

DETAILED DESCRIPTION

This disclosure generally relates to a device 10 to control the movement of a contamination cover provided on a machine bracket for preventing contamination of at least one fluidconnector disposed on the machine bracket. This disclosure also relates to a coupling arrangement 110 for coupling a machine hydraulic fluid circuit to a work tool hydraulic fluid circuit.

Figure 1:
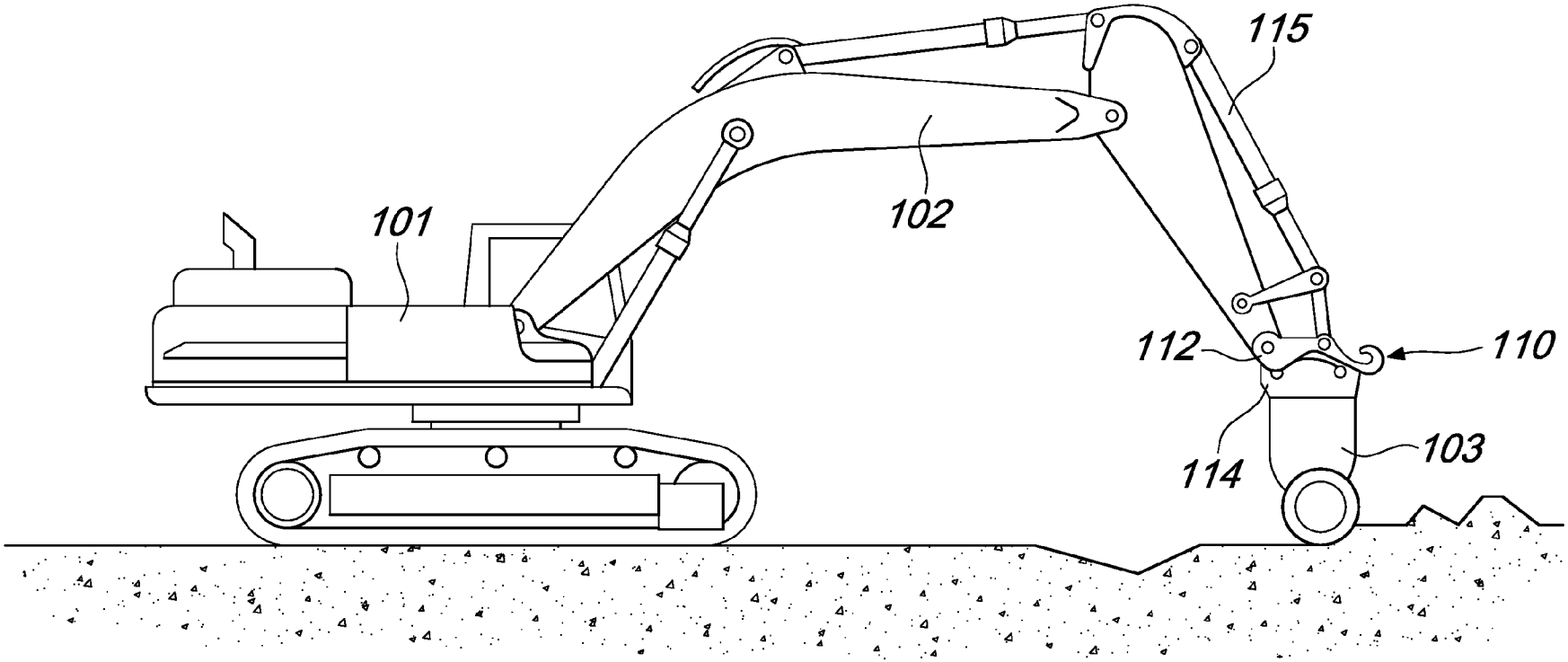
FIG. 1 is a side view of a machine and a work tool provided with a device according to the present disclosure.

FIG. 1 illustrates a host machine 101, as a hydraulic excavator, which may be provided with a hydraulic boom mechanism for driving a boom 102 and a work tool 103. In this description, a boom 102 may be understood as comprising a hydraulic stick mechanism, or similar mechanisms.

Machine 101 may be a mobile machine such as for example an excavator, a back hoe, a digger, a loader, a knuckle boom loader, a harvester or a forest machine. The work tool 103 may be coupled to the machine 101 through the boom 102. In the embodiment shown, the work tool 103 may comprise a rotary cutter. In other embodiments, work tools 103 may for example include buckets, grapples, hammers and pulverizers.

The work tool 103 may comprise a frame which carries multiple exchangeable and/or interchangeable tools.

The work tool 103 may comprise a work tool bracket 114 and the machine 101 may comprise a machine bracket 112. The work tool bracket 114 and machine bracket 112 may each comprise fluidconnectors. The machine bracket 112 may be a quick coupler.

The machine 101 may be provided with a device 10 and a coupling arrangement 110. The device 10 may actuate a contamination cover provided on the machine bracket 112. The coupling arrangement 110 may allow for fluid coupling between the machine bracket 112 and the work tool bracket 114.

A pressurised fluid assembly 115 may extend along the boom 102 for moving the boom 102 and the work tool 103. The pressurised fluid assembly 115 may comprise multiple hydraulic circuits, including a machine fluid circuit and an actuation fluid circuit 9.

The work tool 103 may comprise a work tool fluid circuit for the hydraulic control thereof. The machine fluid circuit may control fluid flow and pressurisation of the fluid through the work tool fluid circuit.

The machine fluid circuit may be arranged to drive the boom 102 and to pivot the boom parts with respect to each other. The machine fluid circuit may be arranged to move the work tool 103. For example, the machine fluid circuit may be arranged to pivot and/or rotate the work tool 103 or may be arranged to drive moving parts in the work tool 103, such as rotary parts.

The actuation fluid circuit 9 may be arranged to enable fluid coupling between the machine fluid circuit and the work tool fluid circuit.

Figure 2:
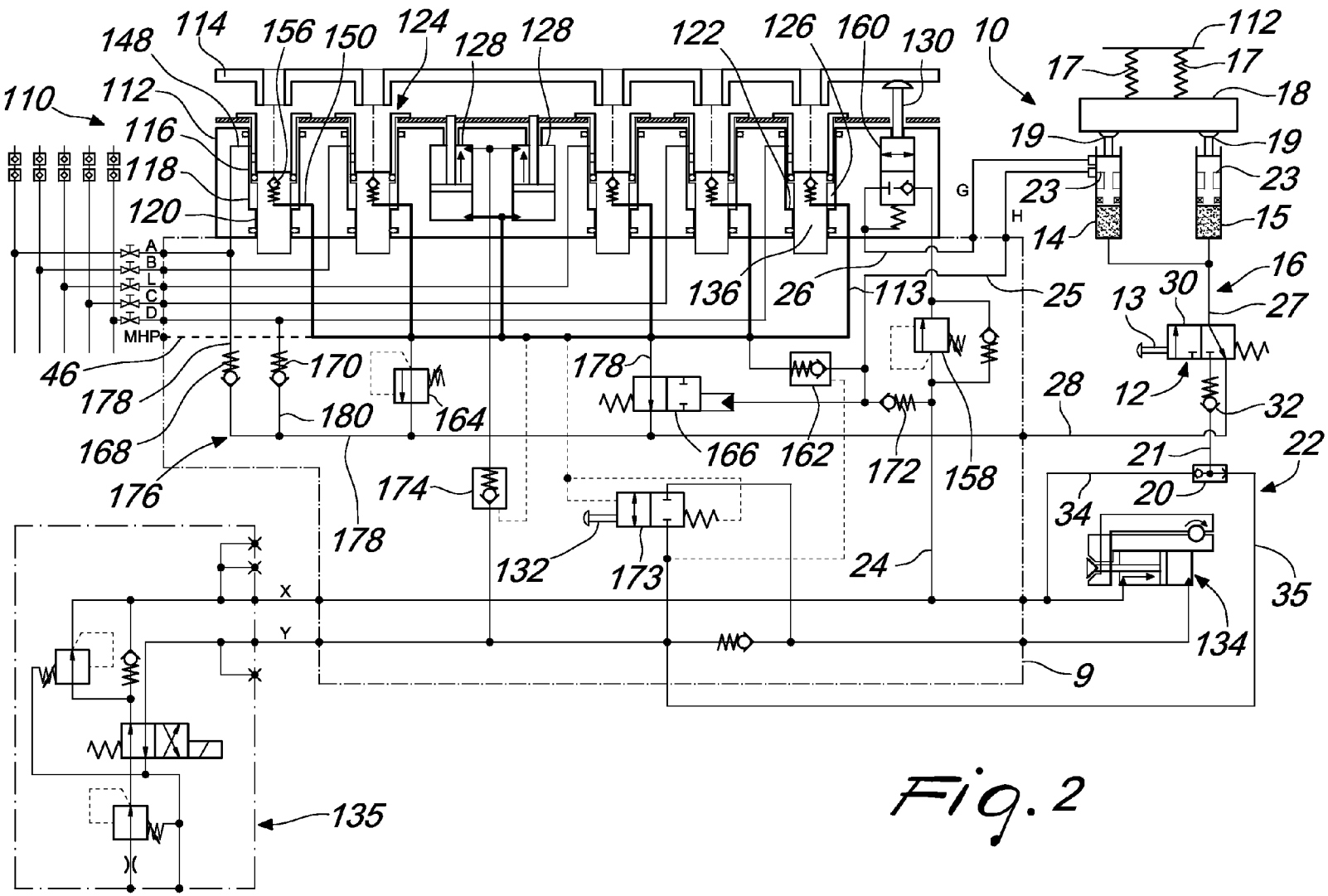
FIG. 2 is a schematic representation of an embodiment of the device connected to a coupling arrangement according to the present disclosure.

FIG. 2 illustrates a schematic representation of an embodiment of a device 10 for actuation a contamination cover 18. The device 10 may control the transition of the contamination cover 18 between an open position and a close position. The contamination cover 18 may be provided on the machine bracket 112.

The contamination cover 18 may be moveable between an open position and a closed position. In the closed position the contamination cover 18 may extend over fluidconnectors disposed in the machine bracket 112. The contamination cover 18 may shield fluidconnectors from contaminants, such as dust, dirt or small rocks. At the open position of the contamination cover 18 the fluidconnectors may be uncovered and may be available for connection to corresponding fluidconnectors that may be disposed in the work tool bracket 114.

The contamination cover 18 may be made of a resilient material. The contamination cover 18 may be able to withstand being subjected to a deformation.

The device 10 may comprise at least one transition cylinder 14, transition circuit 16 and a transition sensor 12.

The first transition cylinder 14 may effect the transition of the contamination cover 18 from the close to the open position.

The first transition cylinder 14 may be positioned on the machine bracket 112. The first transition cylinder 14 may be mounted on the machine bracket 112 by suitable means. The first transition cylinder 14 may be disposed in any suitable position on the machine bracket 112.

The first transition cylinder 14 may be a hydraulic cylinder comprising a cylinder barrel wherein a piston may be connected to a transition piston rod 19. The first transition cylinder 14 may be connected to the contamination cover 18. The first transition cylinder 14 may be connected to the contamination cover 18 through the transition piston rod 19. The movement of the transition piston rod 19 may effect the transition of the contamination cover 18 from the close position to the open position.

The transition piston rod 19 of the transition cylinder 14 may be connected to the contamination cover 18 through a suitable mechanical connection. The transition piston rod 19 may be connected to a suitable connection point on the contamination cover 18. In an embodiment, the transition piston rod 19 may be connected to a centre region of the contamination cover 18.

The transition circuit 16 may comprise hydraulic fluid lines that connect to the first transition cylinder 14. In an embodiment, the transition circuit 16 may comprise hydraulic fluid lines that connect to the piston side chamber of the first transition cylinder 14.

The device 10 may comprise at least one biasing element 17. In an embodiment, the biasing element 17 may be connected at one end to the machine bracket 112 and at the opposite end to the contamination cover 18. In an embodiment, the biasing element 17 may be connected at one end to the first transition cylinder 14 and at the opposite end to the contamination cover 18.

The biasing element 17 may be compressed when the contamination cover 18 is moved from the close position to the open position. The compressed biasing element 17 may drive the transition of the contamination cover 18 from the open position to the close position.

In an embodiment, the biasing element 17 may be a coil spring.

In an embodiment, the device 10 may further comprise a second transition cylinder 15 which is hydraulically connected to the transition circuit 16. The second transition cylinder 15 may be positioned on the machine bracket 112. The second transition cylinder 15 may be a hydraulic cylinder comprising a cylinder barrel wherein a piston may be connected to a transition piston rod 19.

The second transition cylinder 15 may be connected to the contamination cover 18. The transition piston rod 19 may be connected to the contamination cover 18. The movement of the transition piston rod 19 of the second transition cylinder 15 in conjunction with the transition piston rod 19 of the first transition cylinder 14 may effect the transition of the contamination cover 18 from the close position to the open position.

The transition piston rods 19 of the first and second transition cylinders 14, 15 may be connected to the contamination cover 18 through suitable mechanical connections. The transition piston rods 19 may be connected to suitable connection points on the contamination cover 18. In an embodiment, the transition piston rods 19 may be connected to opposite sides of the contamination cover 18.

The device 10 may comprise a further biasing element 17. In an embodiment, the further biasing element 17 may be connected at one end to the machine bracket 112 and at the opposite end to the contamination cover 18. In an embodiment, the further biasing element 17 may be connected at one end to the second transition cylinder 15 and at the opposite end to the contamination cover 18.

The transition circuit 16 may comprise hydraulic fluid lines that connect to the second transition cylinder 15. In an embodiment, the transition circuit 16 may comprise hydraulic fluid lines that connect to the piston side chamber of the second transition cylinder 15.

The transition circuit 16 may enable the transmission of hydraulic pressure to the first and/or second transition cylinder 14, 15. In an embodiment, hydraulic fluid may flow from a source of hydraulic fluid through the lines of the transition circuit 16 to the first transition cylinder 14 for the transmission of hydraulic pressure to the first transition cylinder 14. In an embodiment, hydraulic fluid may flow from a source of hydraulic fluid through the lines of the transition circuit 16 to the first and second transition cylinders 14, 15 for the transmission of hydraulic pressure to the first and second transition cylinders 14, 15.

The transition sensor 12 may be coupled to the transition circuit 16 to control the transmission of hydraulic pressure to the first and/or second transition cylinder 14, 15. The activation of the transition sensor 12 may permit the transmission of hydraulic pressure to drive the first and/or second transition cylinder 14, 15 for transition of the contamination cover 18 from a close to an open position. The activation of the transition sensor 12 may permit the transmission of hydraulic pressure to drive the first and/or second transition cylinder 14, 15 for transition of the contamination cover 18 from a close to an open position.

The transition sensor 12 may detect the presence of a work tool bracket 114. The movement of the work tool bracket 114 to the machine bracket 112 may activate the transition sensor 12.

In an embodiment, the movement to activate the transition sensor 12 may consists of an alignment movement of the machine bracket 112 relative to the worktool bracket 114. The transition sensor 12 may be in pressing engagement if alignment is completed.

In an embodiment, the movement to activate the transition sensor 12 may consists of an alignment and rotating movement of the machine bracket 112 relative to the worktool bracket 114. The transition sensor 12 may be in pressing engagement if alignment and rotation is completed.

The transition sensor 12 may comprise a mechanical or an electronic sensor. In an embodiment the transition sensor 12 may be a solenoid or a hydromechanical device.

In an embodiment, the transition sensor 12 may comprise a hydromechanical switch 13 that may activated upon a pressing engagement with the work tool bracket 114 during alignment of the work tool bracket 114 and the machine bracket 112. The pressing engagement of the work tool bracket 114 to the hydromechanical switch 13 may effect the extraction of the transition piston rod 19 of the second transition cylinder 15 and/or the transition piston rod 19 of the first transition cylinder 14 for the movement of the contamination cover 18 from the close position to the open position.

During the process of aligning the machine bracket 112 and the work tool bracket 114, prior to establishing the mechanical connection, the hydromechanical switch 113 may be in pressing engagement with the work tool bracket 114.

The transition sensor 12 may be normally not be activated and the flow of fluid through the transition circuit 16 to the first and/or second transition cylinder 14, 15 may be blocked. At activation the transition sensor 12 fluid may be allowed to flow through the transition circuit 16 to the first and/or second transition cylinder 14, 15. Activation of the transition sensor 12 may allow transmission of hydraulic pressure to the first and/or second transition cylinder 14, 15.

The transition sensor 12 may comprise a valve 30 provided in the transition circuit 16. In an embodiment, the mechanical or the electronic sensor may be coupled to the valve 30. In an embodiment, the hydromechanical switch 13 may be coupled to the valve 30.

In an embodiment, the valve 30 may be a 3/2 directional valve.

The valve 30 may control the flow of hydraulic fluid through the transition circuit 16. The valve 30 may be normally closed. At activation of the transition sensor 12 the valve 30 may be opened to permit flow of hydraulic fluid.

Activation of the transition sensor 12 may effect the actuation of the valve 30 to permit flow of fluid through the transition circuit 16. Activation of the transition sensor 12 may effect the actuation of the valve 30 to permit flow of hydraulic pressure to the first and/or second transition cylinder 14, 15.

In an embodiment, the pressing engagement of the work tool bracket 114 to the hydromechanical switch 13 may be coupled to the actuation of the valve 30.

The hydromechanical switch 13 may be coupled to a resilient element. In an embodiment the resilient element may be a torsional spring. The pressing engagement of the work tool bracket 114 to the hydromechanical switch 13 may effect a compression of the resilient element. The resilient element may push the hydromechanical switch 13 to the initial position when the pressing engagement is removed. The valve 30 may return to the closed position.

The valve 30 may be connected to the fluid lines of the transition circuit 16. A fluid line 27 may carry hydraulic fluid to the first transition cylinder 14. The transition circuit 16 may include a further fluid line connecting line 27 to the second transition cylinder 15. Hydraulic fluid may flow to and from the piston side chamber of the first and/or second transition cylinder 14, 15 through the transition circuit 16.

Hydraulic fluid flowing from the valve 30 may be transmitted to the first and second transition cylinders 14, 15 such that synchronised extraction of the transition piston rods 19 move the contamination cover 18 from the close position to the open position. The transition of the contamination cover 18 may be effected in a smooth motion by the two transition piston rods 19 that are driven by the flow of substantially equal volumes of fluid into the piston side chambers of the first and second transition cylinder 14, 15.

During extraction of the two transition piston rods 19, the respective biasing elements 17 may be compressed. The force needed for the compression may be higher than the resistance on the two transition piston rods 19 provided by various components of the first and second transition cylinders 14, 15. The biasing elements 17 may ensure synchronized extraction of the first and second transition cylinders 14, 15.

The valve 30 may be arranged in the transition circuit 16 so that a fluid line 21 may carry hydraulic fluid from a hydraulic fluid source to the valve 30. At activation of the transition sensor 12 the valve 30 may be opened to allow hydraulic fluid to flow from the fluid line 21 through the valve 30 to the fluid line 27.

The valve 30 may be connected to a line 28 in alternate to line 21. The line 28 may be connected to the actuation fluid 9. The fluid line 28 may be connected to a drain circuit 176 provided in the actuation fluid circuit 9. When the transition sensor 12 is not activated the valve 30 may be closed so that hydraulic fluid may flow from the first and/or second transition cylinder 14, 15 through the line 27 and the valve 30 to the fluid line 28.

The device 10 may further comprise a shuttle valve 20 connected to the transition circuit 16. The shuttle valve 20 may be provided to the fluid line 21. Hydraulic fluid may flow through the shuttle valve 20 and into the transition circuit 16.

The shuttle valve 20 may be connected to further hydraulic fluid lines through which hydraulic fluid may be delivered to the shuttle valve 20. The shuttle valve 20 may be pressure actuated. The channel in the shuttle valve 20 with the highest hydraulic pressure may open to permit flow of hydraulic fluid from the hydraulic line having the higher hydraulic pressure.

In an embodiment, the further hydraulic fluid lines connected to the shuttle valve 20 may be a bypass circuit 22. The bypass circuit 22 may comprise at least two fluid lines 34, 35. The fluid lines 34, 35 may be separately connected to the shuttle valve 20. The bypass circuit 22 may be connected to a first hydraulic line X and a second hydraulic line Y. Line 34 may be connected to line X and line 35 may be connected to line Y. The first and the second hydraulic lines X, Y may be further connected to a locking device 134

The locking device 134 may be moved to the unlocked position when pressure in line X is increased. The locking device 134 may be moved to the locked position when pressure in line Y is increased.

In an embodiment, the further hydraulic fluid lines connected to the shuttle valve 20 may be a bypass circuit 22 and the first and the second hydraulic lines X, Y.

The line 21 may be provided with a non-return valve 32 to prevent a return flow of hydraulic fluid from the valve 30 towards the hydraulic fluid source. The non-return valve 32 valve may ensure that the contamination cover 18 will remain open when the shuttle valve 20 is actuated by a higher pressure in alternate line. The non-return valve 32 may ensure that the contamination cover 18 will remain open even when the pressure acting on the shuttle valve 20 is lower than the pressure in the first and/or second transition cylinder 14, 15.

The device 10 may receive the hydraulic pressure from a hydraulic power circuit 135. The hydraulic pressure from the hydraulic power circuit 135 may be transmitted to the transition circuit 16 and to the first transition cylinder 14 and/or the second transition cylinder 15.

The hydraulic power circuit 135 may be connected to further hydraulic fluid lines. In an embodiment, hydraulic power circuit 135 may be connected to the bypass circuit 22. In an embodiment, hydraulic power circuit 135 may be connected to the first and the second hydraulic lines X, Y.

With reference to FIG. 2, the device 10 may be hydraulically connected to the actuation fluid circuit 9. The first transition cylinder 14 or the second transition cylinder 15 may be connected to the actuation fluid circuit 9. Hydraulic fluid may flow to the first transition cylinder 14 or the second transition cylinder 15 of device 10 through line X, line 24, line 26, and line G. Hydraulic fluid may flow from the first transition cylinder 14 or the second transition cylinder 15 of device 10 through line H and line 25.

In an embodiment, the first transition cylinder 14 and the second transition cylinder 15 may be connected to the actuation fluid circuit 9. Hydraulic fluid may flow to the first transition cylinder 14 and the second transition cylinder 15 of device 10 through line X, line 24 and line 26. Line 26 may be connected to the first and second transition cylinders 14, 15 through two separate lines G. Hydraulic fluid may flow from the first transition cylinder 14 and the second transition cylinder 15 of device 10 to two separate lines H that connect to the line 25.

In an embodiment, the actuation fluid circuit 9 may comprise lines X, 24, 26, G, H and 25.

The device 10 may comprise a coupling switch 23 in the first transition cylinder 14 and/or the second transition cylinder 15.

In an embodiment, the coupling switch 23 may be provided in the transition piston rod 19 of the first transition cylinder 14 and/or the second transition cylinder 15. The coupling switch 23 may connect lines G and H to enable flow of fluid through the actuation fluid circuit 9. The coupling switch 23 may be in fluid communication simultaneously with lines G and H when the transition piston rod 19 moves the contamination cover 18 to the open position. The transition piston rod 19 may be in the extracted position for the coupling switch 23 to be in simultaneous fluid communication with lines G and H. At the extracted position of the transition rod 19 fluid may flow from line G to line H. Hydraulic pressure may be transmitted through the actuation fluid circuit 9 with the coupling switch in simultaneous fluid communication with lines G and H.

Figure 3:
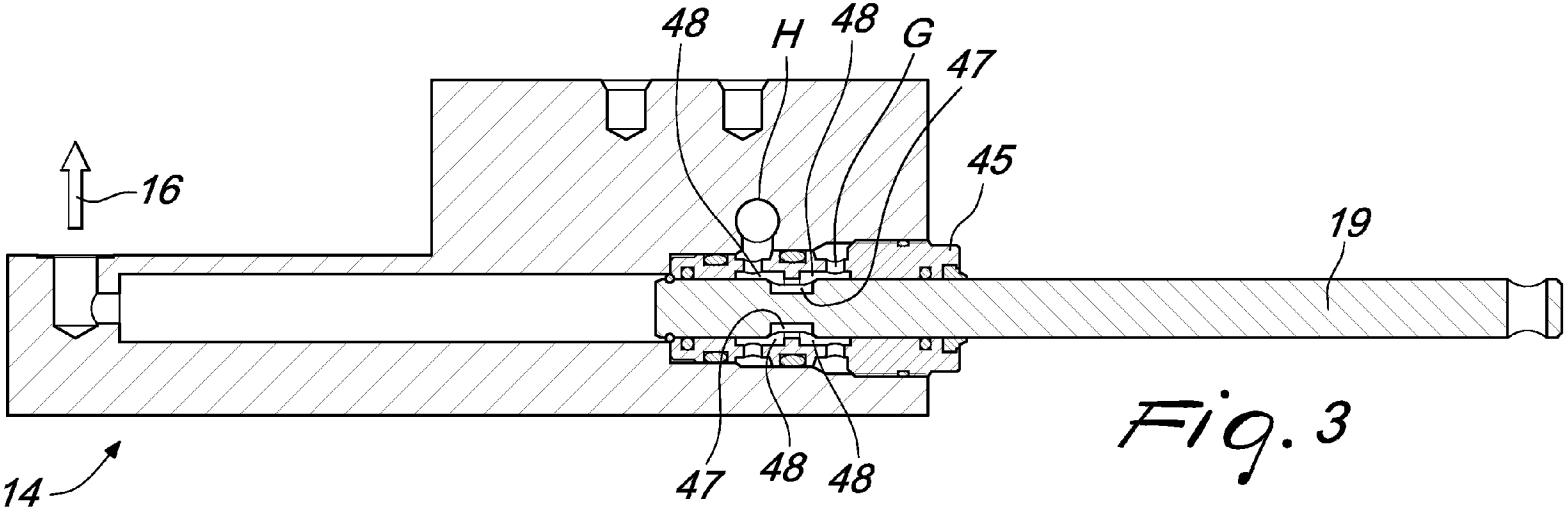
FIG. 3 is a cross-sectional view of a transition cylinder at a extracted position according to the present disclosure.

FIG. 3 illustrates a cross-section of the first transition cylinder 14 in a fully extracted position. The coupling switch 23 may comprise a piston-rod recess portion 47 disposed on the transition piston rod 19 and a piston-head recess portion 48 disposed on a piston head 45.

The coupling switch 23 may be in simultaneous fluid communication with lines G and H, with openings of lines G and H leading to the piston-head recess portion 47 and when the piston-rod recess portion 47 is positioned adjacent to the piston-head recess portion 48.

In an embodiment, the coupling switch 23 may comprise a piston-rod recess portion 47 disposed on the transition piston rod 19. The coupling switch 23 may be in simultaneous fluid communication with lines G and H, with openings of lines G and H being positioned adjacent the piston-rod recess portion 47.

The coupling switch 23 may not be in fluid communication with lines G and H when the biasing element 17 moves the contamination cover 18 to the close position. The transition piston rods 19 may be retracted so that the coupling switch 23 may no longer be in fluid communication with lines G and H. The lines G and H may be sealed by the transition piston rod 19.

Figure 4:
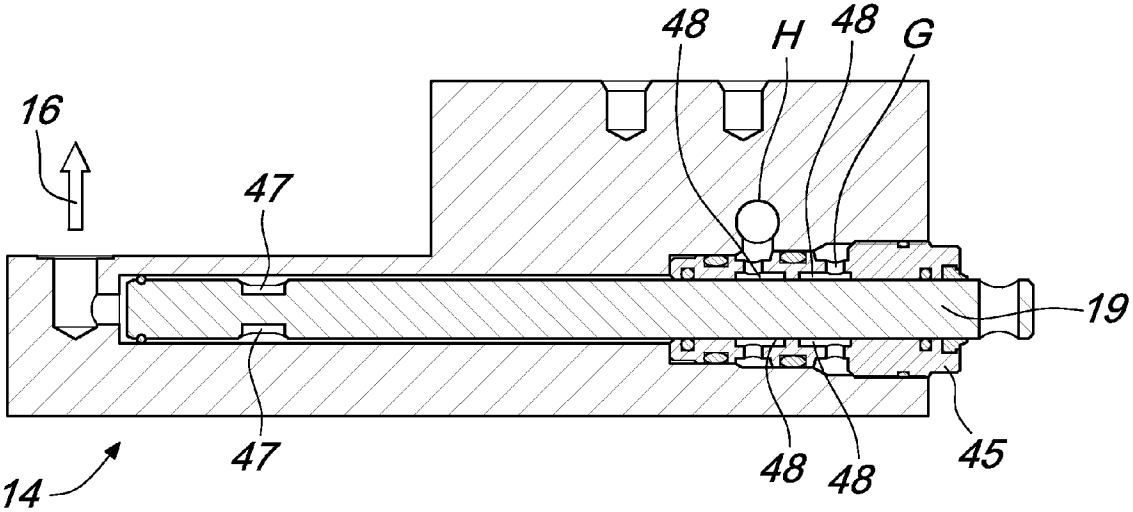
FIG. 4 is a cross-sectional view of a transition cylinder at an retracted position according to the present disclosure.

FIG. 4 illustrates a cross-section of the first cylinder 14 in a retracted position. The coupling switch 23 may not be in simultaneous fluid communication with lines G and H, when the piston-rod recess portion 47 is in a distant position from the piston-head recess portion 48.

In an embodiment, the coupling switch 23 may not be in simultaneous fluid communication with lines G and H, with openings of lines G and H being in a distant position from the piston-rod recess portion 47.

In operation of the device 10, the contamination control cover 18 may move from the close position to the open position so that the fluidconnectors disposed on the machine bracket 112 may be available to connect to fluidconnectors disposed on the work tool bracket 114. The contamination cover 18 may remain closed if a work tool bracket 114 does not have fluidconnectors or if a bucket is connected to the machine bracket 112.

A method of actuating a contamination cover 18 of the machine bracket 112, may comprise the steps of transmitting a hydraulic pressure to a transition circuit 16 connected to a first transition cylinder 14, the first transition cylinder 14 being mounted on the machine bracket 112 and being connected to the contamination cover 18 and activating a transition sensor 12 coupled to the transition circuit 16, wherein the activation of the transition sensor 12 permits the transmission of the hydraulic pressure to drive the first transition cylinder 14 for the transition of the contamination cover 18 from a close to an open position.

Prior to coupling of the work tool bracket 114 to the machine bracket 112, the machine bracket 112 may be rotated relative to the work tool bracket 114. At this initial stage the first and/or second transition cylinder 14, 15 may be retracted and the contamination cover 18 may be in the close position.

As the work tool bracket 114 to the machine bracket 112 are aligned for coupling, the work tool bracket 114 may come into pressing engagement with the transition sensor 12. The pressing engagement may result in the transition sensor 12 being open for flow of hydraulic fluid through the transition fluid circuit 16. The valve 30 may open to permit flow of hydraulic fluid through the transition fluid circuit 16 to the first and/or second transition cylinder 14, 15. Hydraulic pressure from the hydraulic fluid may push the transition piston rod 19 the first and/or second transition cylinder 14, 15 from the retracted position to the extracted position.

As the transition piston rod 19 is extracted, the contamination cover 18 may be moved from the close position to the open position. The biasing element 17 may be compressed as the contamination cover 19 is moved to the open position.

When the contamination cover 18 is at the open position the first and/or second transition cylinder 14, 15 may be at the final extracted position so that the coupling switch 23 may be in simultaneous fluid communication with lines G and H. Hydraulic fluid may be permitted to flow through the actuation fluid circuit 9 by the connection of the coupling switch 23 to the actuation fluid circuit 9.

If the contamination cover 18 is not entirely open, coupling switch 23 may not be in fluid communication with lines G and H and hydraulic fluid may not be permitted to flow through the actuation fluid circuit 9. At partial extraction of the transition piston rod 19 the coupling switch 23 may not be in fluid communication with lines G and H.

The hydraulic power circuit 135 may be activated to transmit hydraulic pressure through the hydraulic fluid to the transition circuit 16 and the actuation fluid circuit 9.

In the embodiment with the hydraulic power circuit 135 connected to further hydraulic fluid lines that are connected to the shuttle valve 20, the hydraulic power circuit 135 may pressure the further hydraulic lines alternatively.

In an embodiment, the hydraulic power circuit 135 may pressurise line 34 and line 35 of the bypass circuit 22 alternatively. In an embodiment, the hydraulic power circuit 135 may pressurise the first and the second hydraulic lines X, Y alternatively. In a further embodiment, the hydraulic power circuit 135 may pressurise both line X and line 34 in alternate to both line Y and line 35.

During alignment of the work tool bracket 114 to the machine bracket 112 and the transition sensor 12 may permit flow of hydraulic fluid to the first transition cylinder 14 and/or the second transition cylinder 15. The flow of hydraulic pressure may flow when any of the hydraulic fluid line is pressurised. The shuttle valve 20 may ensure flow fluid through the transition circuit 16 when any of the hydraulic fluid line is pressurised.

The shuttle valve 20 may ensure reliable opening of the contamination cover 18 in any operation mode of the device 10. In embodiment, hydraulic pressure may be transmitted through the transition circuit 16 when either of line 34 and line 35 of the bypass circuit 22 is pressurised. In embodiment, hydraulic pressure may be transmitted through the transition circuit 16 when either the first and the second hydraulic lines X, Y is pressurised.

In an operating mode of the device 10, a work tool bracket 114 may be required for connection at start-up of the machine. The work tool bracket 114 and the machine bracket 112 may be aligned but not connected while the locking device 134 is in the locked position. In the embodiment where the connecting movement consists of an alignment and rotating movement of the machine bracket 112 relative to the worktool bracket 114, the alignment may be completed with the locking device 134 in the locked position. The rotating movement may only be completed with the locking device 134 in the unlocked position. The transition sensor 12 may be in pressing engagement if alignment and rotation is completed.

In an embodiment, the both line X and line 34 may be initially pressurised at an amount below the maximum machine pressure and both line Y and line 35 may be at tank pressure. Hydraulic pressure may be transmitted through line X and line 34 to the shuttle valve 20 into the transition circuit 16. The contamination cover 18 may be moved to the open position upon pressing engagement of the work tool bracket 114 with the transition sensor 12 as the hydraulic pressure may be transmitted from the transition circuit 16 to the first and/or second transition cylinder 14, 15. The locking device 134 may be subsequently actuated to the unlocked position prior to the engagement of the work tool bracket 114 and the machine bracket 112. Both line X and line 34 may be depressurised. The pressure in both line X and line 34 may drop to tank pressure. Subsequently, both line Y and line 35 may be pressurised to full machine pressure. The shuttle valve 20 may be actuated to now permit flow of fluid from the line Y and line 35. The non return valve 32 may not allow fluid to flow from the first and/or second transition cylinder 14, 15 to the transition circuit 16. The hydraulic pressure in the first and/or second transition cylinder 14, 15 may be maintained so that the contamination cover is retained in the fully open position.

In a further operation mode a work tool 103 change may be required. The work tool bracket 114 and the machine bracket 112 may be aligned but not connected while the locking device 134 is already in the unlocked position. Both line Y and line 35 may be already pressurised to full machine pressure. The shuttle valve 20 may permit fluid flow into the transition circuit 16. Upon pressing engagement of the work tool bracket 114 with the transition sensor 12, hydraulic pressure may be transmitted to the first and/or second transition cylinder 14, 15 for the transition of the contamination cover 18 from the close position to the open position.

Upon connection of the work tool bracket 114 and the machine bracket 112 the locking device 134 may be moved to the locked position. The line Y may be depressurised and line X may be pressurised to move the locking device 134 to the locked position. Simultaneously, line 35 may be depressurised and line 34 may be pressurised. The non return valve 32 may not allow fluid to flow from the first and/or second transition cylinder 14, 15 to the transition circuit 16 as pressure is switched from line 35 to line 34. The hydraulic pressure in the first and/or second transition cylinder 14, 15 may be maintained so that the contamination cover is retained in the fully open position.

In an a further operation mode a work tool bracket 114 may be connected to the machine bracket 112 at start-up of the machine. The locking device 134 may be in the locked position but may not be under pressure from the hydraulic power circuit 135. The contamination cover 18 may be retained at the fully open position. The non return valve 32 may not allow fluid to flow from the first and/or second transition cylinder 14, 15 to the transition circuit 16 as of work tool bracket 114 is in pressing engagement with the transition sensor 12

In an embodiment, when the machine is started the pressure in line X and line 34 may be increased to 120 bar and hydraulic pressure may be transmitted to the transition circuit 16.

At decoupling of a work tool bracket 114 to a machine bracket 112, the work tool bracket 114 may not be in pressing engagement with the transition sensor 12. The valve 30 may be actuated to the close position so that fluid from the hydraulic power circuit 135 may not flow through the transition circuit 16 to the first and/or second transition cylinder 14, 15. The fluid in the first and/or second transition cylinder 14, 15 may flow into the fluid line 28. The biasing elements 17 in the compressed state may move the contamination cover 18 from the open position to the close position. The biasing elements 17 may ensure smooth closure of the contamination cover 18 when the work tool bracket 114 and the machine bracket 112 are being decoupled.

FIG. 2 further illustrates a schematic representation of an embodiment of a coupling arrangement 110 with hydraulic connections for connecting a machine bracket 112 to a work tool bracket 114 and for forming at least one fluid passage between the machine fluid circuit and the work tool fluid circuit.

The coupling arrangement 110 may comprise the machine bracket 112 which may be provided with at least one cavity 116. The cavity 116 may extend through the machine bracket 112 and may have a cavity wide portion 118 and a cavity narrow portion 120.

Cavity narrow portion 120 may be formed as a plurality of extensions of the wall of cavity 116. In an embodiment, the cavity narrow portion 120 may be a single block extension of the wall of cavity 116. A shoulder 122 may be formed between the cavity wide portion 118 and the cavity narrow portion 120.

The coupling arrangement 110 may comprise a coupler assembly 124 movably mounted in the cavity 116. Both the cavity 116 and the coupler assembly 124 may be correspondingly shaped to allow for the relative movement of the coupler assembly 124. The coupler assembly 124 may be slidably mounted with at least portions thereof being in sliding engagement with the wall of the cavity 116. The coupler assembly 124 may slide between a retracted position, where the coupler assembly 124 retracts fully or partially into the cavity 116, and an extended position, where the coupler assembly 124 protrudes from the machine bracket 112 for engagement with a corresponding fluid coupler in the work tool bracket 114. The terms fluid coupler and fluidconnector may be used interchangeably.

The coupling arrangement 110 may comprise a chamber 126 provided in the cavity 116. In an embodiment the chamber 126 may be formed in the cavity wide portion 118 and may be bounded by the wall of the cavity wide portion 118, the shoulder 122 and the coupler assembly 124.

The size of chamber 126 may vary through the movement of the coupler assembly 124 relative to the machine bracket 112. The size of chamber 126 may be made to vary through the inflow and outflow of hydraulic fluid which may move the coupler assembly 124 relative to the machine bracket 112. The changes in the size of the chamber 126 may effect the corresponding retraction and extension of the coupling assembly 124.

In an embodiment the machine bracket 112 may be provided with a series of cavities 116. Each cavity 116 may have a movably mounted coupler assembly 124 and a chamber 126. For fluid coupling the machine bracket 112 to a work tool bracket 114, the work tool bracket 114 may comprise fluid couplers which connect to corresponding coupler assemblies 124 mounted in the machine bracket 112. Fluid coupling the machine bracket 112 to a work tool bracket 114 may be effected with the coupler assemblies 124 in the fully extended positions or the connect position. The coupler assemblies 124 may be in a disconnect position when retracted from the fully extended position.

For operation and control of the coupling arrangement 110 the hydraulic connections may be suitably provided. The machine fluid circuit may comprise hydraulic lines leading to the cavities 116 for connection to respective coupler assemblies 124. In an embodiment, hydraulic lines A, B, C, D and L of the machine fluid circuit may allow flow of hydraulic fluid to and from the work tool fluid circuit when fluid coupling between the brackets 112, 114 are established. Hydraulic fluid may flow through the coupler assemblies 124 in the connect position to and from the corresponding fluid couplers in the work tool bracket 114.

The coupling arrangement 110 may include hydraulic connections to a quick coupler mechanism for locking together brackets 112, 114, such as a quick coupler wedge.

The actuation fluid circuit 9 may be controlled independently from the machine fluid circuit. The actuation fluid circuit 9 may include at least one actuator 128. In an embodiment, the actuator may be a hydraulic cylinder. The actuator 128 may be connected contemporaneously to all the coupler assemblies 124. The actuator 128 may be connected to the coupler assemblies 124 through suitable linkages such as through a connecting rod.

Refraction or extension of the actuator 128 may correspondingly retract or extend the coupler assemblies 124 to a disconnect position or to a connect position respectively. The coupler assemblies 124 may be uniformly retracted or extended by the actuator 128.

In an embodiment, a pair of actuators 128 may be provided to ensure an evenly balance load for fluid coupling or decoupling between the coupler assemblies 124 and the corresponding fluid couplers.

The operation of the actuation fluid circuit 9 may be controlled by the device 10 through the connection and disconnection of coupling switch 23 and the lines G and H.

The operation of the actuation fluid circuit 9 may be further controlled by the bracket switch 130.

Bracket switch 130 may control hydraulic fluid flow for the extension of the coupler assemblies 124. Bracket switch 130 may be suitably disposed in order to detect when a work tool bracket 114, having at least one corresponding fluid coupler, is mounted to a machine bracket 112. In an embodiment, the bracket switch 130 may be suitably positioned on the machine bracket 112. The bracket switch 130 may not be activated if the work tool bracket 114 does not carry any corresponding fluid couplers and fluid coupling may not be effected as no flow of hydraulic fluid to extend the coupler assemblies 124 to the connect position is permitted by the bracket switch 130. Bracket switch 130 may prevent actuation of the coupler assemblies 124 when no corresponding fluid couplers are present in the attached work tool bracket 114.

The operation of the machine fluid circuit may be further controlled by a switch 132. Switch 132 may control the flow of hydraulic fluid to the locking device 134 for the unlocking of the brackets 112, 114. Switch 132 may be arranged to be activated only when the actuator 128 is in a fully retracted position. The switch 132 may be arranged not to be activated when the actuator 128 is in an extended position and unlocking of the brackets 112, 114 may not be effected as no flow of hydraulic fluid to actuate the locking device 134 is permitted by the switch 132. Switch 132 prevents premature decoupling between the machine bracket 112 and the work tool bracket 114 when coupler assemblies 124 have not been retracted from the connect position.

In an embodiment the switches 130, 132 may be sensors connected to actuating mechanisms. In an embodiment the switches 130, 132 may be a solenoid or a hydro mechanical device. In an embodiment the switches 130, 132 may be hydromechnical switches which are activated upon physical contact with work tool bracket 114 and the actuator 128.

The coupling arrangement 110 may further comprise a rail circuit 113, denoted by a bold line in FIG. 2, which connects together each chamber 126. The rail circuit 113 may be comprised of a single hydraulic line connected to each of the chambers 126 through further hydraulic lines. The rail circuit 113 may distribute the fluid pressure equally among the chambers 126. Accordingly, the highest pressure in any one chamber 126 may generate the load required to effect the corresponding extension of the coupler assemblies 124 in the other chambers 126. The chamber 126 having the highest working pressure may define the force presented to all coupler assemblies 124.

A diagnostic line 46 may be provided for the testing and analysis of the rail circuit 113.

The rail circuit 113 may be connected to the actuators 128. In an embodiment, the rail circuit 113 may be connected to the piston side of the actuators 128, provided as a hydraulic cylinder.

The coupling arrangement 110 may be connected to the hydraulic power circuit 135. The hydraulic power circuit 135 may provide hydraulic pressure to lock and unlock machine bracket 112 to the work tool bracket 114. Unlocking of the brackets 112, 114 by the hydraulic power circuit 135 may be controlled by the switch 132 through hydraulic connections between the hydraulic power circuit 135 and the switch 132.

The hydraulic power circuit 135 may be connected to the actuator 128. In an embodiment, the hydraulic power circuit 135 may be connected to the rod side of the actuator 128, provided as a hydraulic cylinder.

The hydraulic power circuit 135 may be arranged to provide pressurised fluid to the rail circuit 113. The coupling switch 23 and the bracket switch 130 may be disposed in the connection between the hydraulic power circuit 135 and the rail circuit 113.

Figure 5:
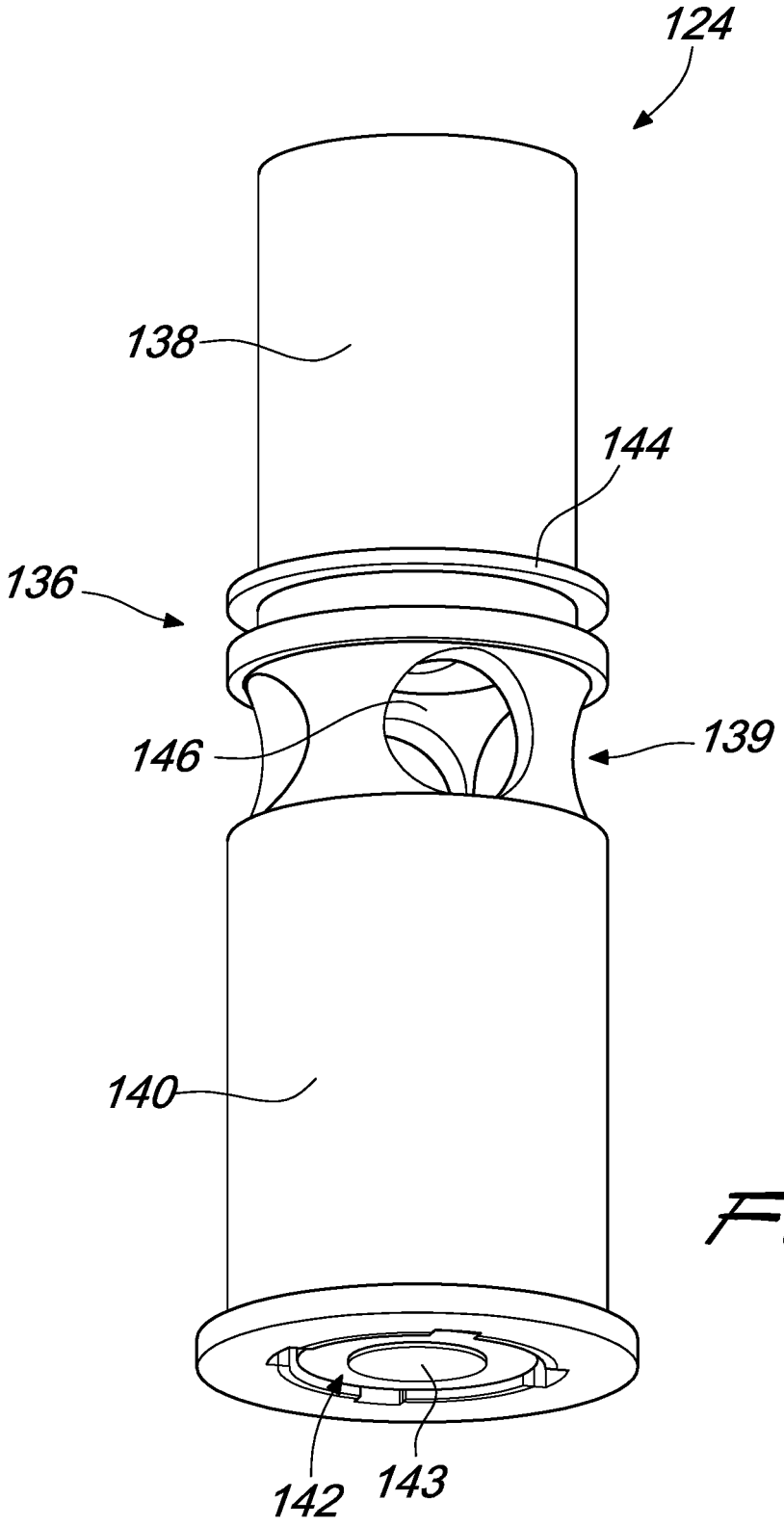
FIG. 5 is an isometric view of an embodiment of a coupling assembly according to the present disclosure.

FIG. 5 illustrates a coupler assembly 124. The coupler assembly 124 may comprise a hollow plunger 136. Plunger 136 may have a suitable form and dimensions to be slidingly mounted within the cavity 116. Plunger 136 may have a plunger narrow portion 138, a gate portion 139 and a plunger wide portion 140. In an embodiment, the gate portion 139 may be positioned within the plunger wide portion 140 and adjacent to the plunger narrow portion 138. The gate portion 139 may be recessed from the plunger wide portion 140.

The plunger narrow portion 138 may be in sliding engagement with the cavity narrow portion 120. The plunger narrow portion 138 may be arranged to sealingly engage with cavity narrow portion 120 to restrict leakage of hydraulic fluid between the plunger narrow portion 138 and the cavity narrow portion 120.

The plunger wide portion 140 may be in sliding engagement with the cavity wide portion 118. The plunger wide portion 140 may be arranged to sealingly engage with cavity wide portion 118 to restrict leakage of hydraulic fluid between the plunger wide portion 140 and the cavity wide portion 118.

The gate portion 139 may not be in contact with wall of the cavity wide portion 118.

A fluid coupler 142 may be positioned within the plunger 136. Plunger 136 may be provided with retaining structures to hold the fluid coupler 142 within the walls thereof. Fluid coupler 142 may have a through fluid channel 143 along the longitudinal axis of the plunger 136. The fluid channel 143 may communicate with the hollow of the plunger 136.

The fluid coupler 142 may couple with the corresponding fluid coupler, having a fluid channel disposed therein, in the work tool bracket 114. Respective fluid channels form a fluid passage when the fluid couplers are connected. At fluid coupling hydraulic fluid from the machine fluid circuit may flow through the fluid channels to the work tool fluid circuit. Fluid coupler 142 may be formed as a male or female element for coupling to the fluid coupler with the corresponding form.

Extending laterally from the plunger 136 may be a pressure element 144. In an embodiment the pressure element 144 may encircle the plunger 136 and may be formed as a rib or a protrusion. In an embodiment the pressure element 144 may extend from and encircle the plunger wide portion 140. With the coupler assembly 124 mounted in the cavity 116, the pressure element 144 may extend from the plunger 136 through the cavity 116 to slidingly engage the wall of the cavity wide portion 118. The pressure element 144 may separate the chamber 126 from rest of the cavity wide portion 118.

The pressure element 144 may be arranged to sealingly engage with the wall of the cavity wide portion 118 to limit leakage of hydraulic fluid between the wall of the cavity wide portion 118 and the pressure element 144. The pressure element 144 may be suitably shaped or may be provided with a gasket to slidingly and sealingly engage cavity wide portion 118.

The pressure element 144 may have a pressure surface 145 which, in an embodiment, may face the shoulder 122. The dimensions and/or shape of the pressure surface 145 may be a function of the diameter of the coupler assembly 124, the diameter of the fluid coupler 142, the diameter of the corresponding fluid coupler in the work tool bracket 114 and/or the difference in the diameters of the fluid coupler 142 and the corresponding fluid coupler. The dimensions and/or shape of the pressure surface 145 may depend on the fluid dynamics of the fluid coupler 142 and the corresponding fluid coupler. Fluid dynamics may be dependent on the structure of fluid couplers, the type of hydraulic fluid and/or the fluid pressure used for the fluid coupling.

At least one bore 146 may be provided in the plunger 136 which may allow flow of hydraulic fluid from the exterior of the plunger 136 into the hollow thereof. The fluid channel 143 of the fluid coupler 142 may communicate through the hollow of the plunger 136 with the bore 146. The bore 146 may be provided in the gate portion 139. In an embodiment, the gate portion 139 may be provided with a plurality of bores 146. Hydraulic fluid may flow around the gate portion 139 guided by walls formed by the plunger wide portion 140 and into the hollow through the plurality of bores 146.

In an embodiment, a single bore 146 may be provided in the plunger 136, not provided with a gate portion 139. The bore 146 may be positioned between the pressure element 144 and the plunger wide portion 140.

The size and the number of the bores 146 may be a function of the diameter of the coupler assembly 124, the diameter of the fluid coupler 142, the diameter of the corresponding fluid coupler in the work tool bracket and/or the difference in the diameters of the fluid coupler 142 and the corresponding fluid coupler. The dimensions and/or shape of the bore 146 may be dependent on the dimension and/or shape of the pressure surface 145. The dimensions and/or shape of the bore 146 may depend on the fluid dynamics of the fluid coupler 142 and the corresponding fluid coupler.

Figure 7:
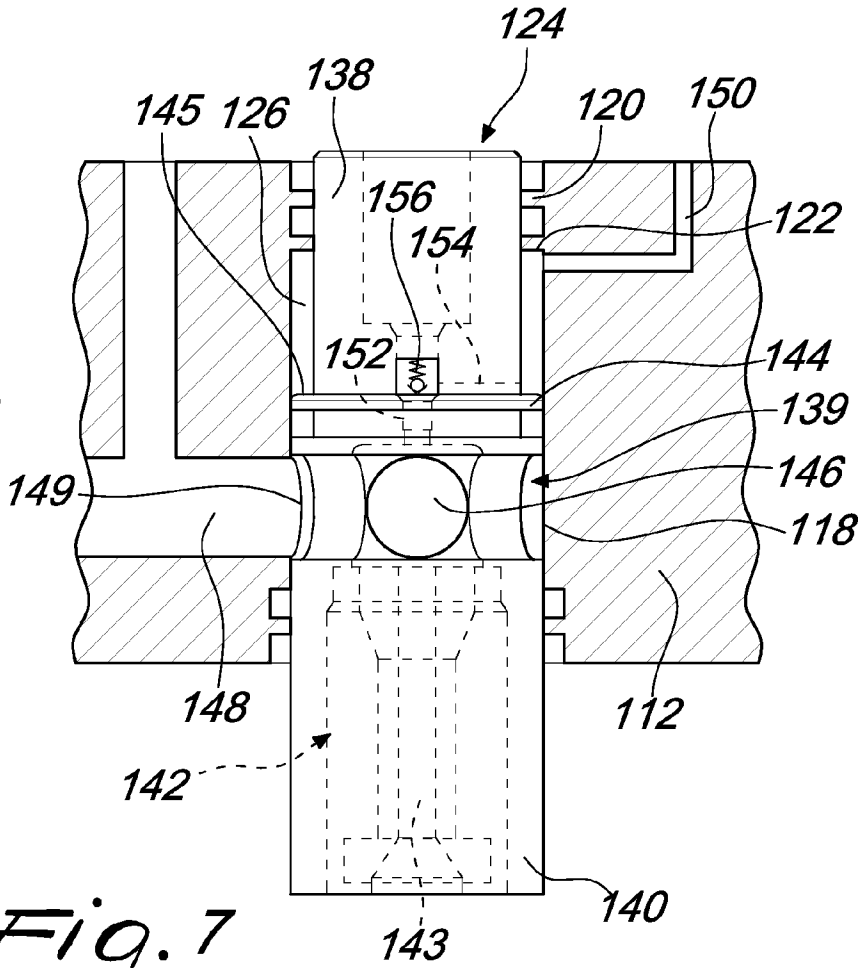
FIG. 7 is a cross sectional view of a mounted coupling assembly in an extended position according to the present disclosure.
Figure 6:
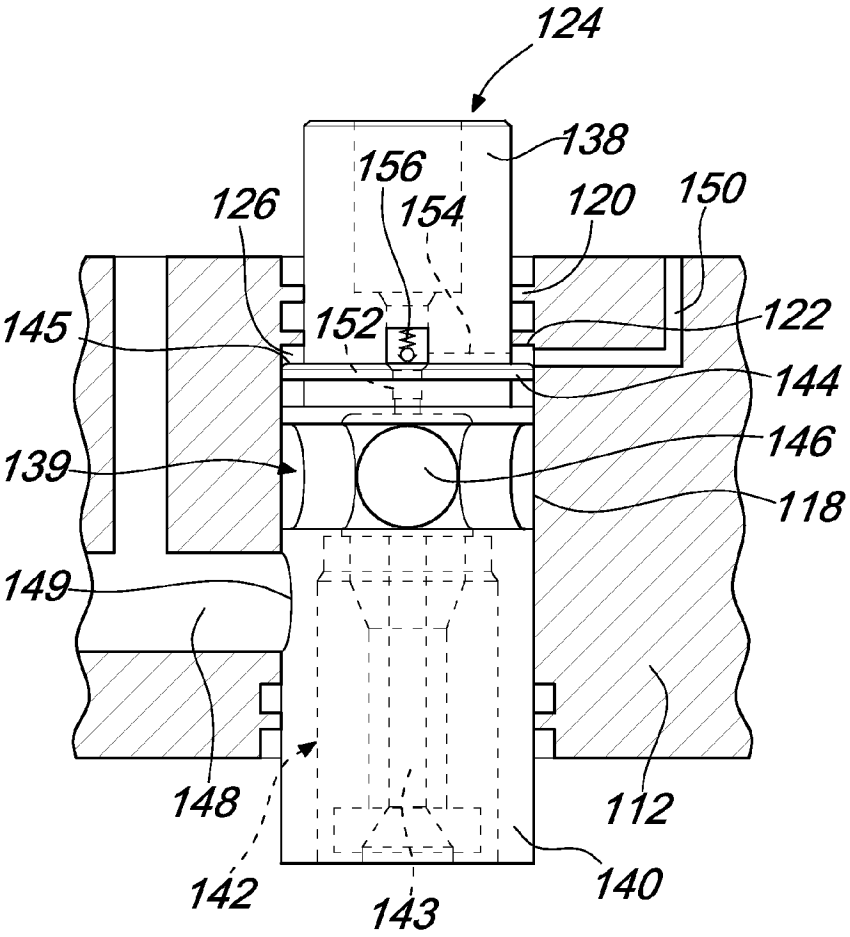
FIG. 6 is a cross sectional view of a mounted coupling assembly in a retracted position according to the present disclosure.

FIGS. 6 and 7 illustrate a coupler assembly 124 slidingly mounted in the machine bracket 112. In FIG. 6 the coupler assembly 124 may be retracted to the disconnect position and in FIG. 7 the coupler assembly 124 may be extracted to the connect position. The retraction of the coupler assembly 124 within the cavity 116 may be limited by the shoulder 122 which may abut pressure surface 145.

Machine bracket 112 may have a machine circuit line 148, which forms part of the machine fluid circuit, leading to the cavity 116. Fluid from the machine fluid circuit may flow through the machine circuit line 148 to the cavity 116 through a port 149. In the machine bracket 112 having plurality of cavities 116, each cavity 116 may be separately connected to the machine fluid circuit through a plurality of corresponding circuit lines 148. In an embodiment, hydraulic lines A, B, C, D and L may allow flow of hydraulic fluid to and from the ports 149 through respective machine circuit lines 148.

Machine bracket 112 may have a rail circuit line 150, which forms part of the rail fluid circuit, leading to the cavity 116. In an embodiment the rail circuit line 150 leads to the chamber 126. Fluid from the rail fluid circuit may flow through the rail circuit line 150 to the chamber 126.

The chamber 126 in the cavity wide portion 118 may be bounded by the wall of the cavity wide portion 118, the shoulder 122, the pressure surface 145 and the plunger narrow portion 138. The size of chamber 126 may depend on the inflow and outflow of hydraulic fluid through the rail circuit line 150. Inflow of fluid into the chamber 126 may result in an increase in fluid pressure therein, as the chamber 126 may be fluid tight. The fluid pressure may act on the surfaces which bound the chamber 126. The increasing fluid pressure acting on the pressure surface 145 may effect extraction of the coupler assembly 124 slidingly mounted in the machine bracket 112. The coupler assembly 124 may be extracted to the connect position through continued inflow of hydraulic fluid under pressure to establish fluid coupling between the fluid coupler 142 and the corresponding fluid coupler in the work tool bracket 114.

A diversion passage 152 may extend axially within the plunger 136 from the gate portion 139 toward the pressure element 144. The diversion passage 152 may be axially aligned with the longitudinal axis of the plunger 136. In an embodiment the diversion passage 152 may extend beyond the pressure element 144. Hydraulic fluid flowing through the bores 146 may flow into the hollow of the plunger 136 and to the diversion passage 152.

The dimensions and/or shape of the diversion passage 152 may be a function of the diameter of the coupler assembly 124, the diameter of the fluid coupler 142, the diameter of the corresponding fluid coupler in the work tool bracket and/or the difference in the diameters of the fluid coupler 142 and the corresponding fluid coupler. The dimensions and/or shape of the diversion passage 152 may be dependent on the dimension and/or shape of the bore 146.

The dimensions and/or shape of the diversion passage 152 may be dependent on the dimension and/or shape of the pressure surface 145. The dimensions and/or shape of the diversion passage 152 may depend on the fluid dynamics of the fluid coupler 142 and the corresponding fluid coupler.

Extending from the diversion passage 152 may be a diversion line 154. The diversion line connects the diversion passage 152 to the chamber 126. In an embodiment the diversion line 154 may extend laterally from the diversion passage 152 to the chamber 126. In an embodiment, the diversion line 154 may be disposed such that the pressure surface 145 is positioned between the bores 146 and the diversion line 154. In an embodiment the diversion passage is a hose mounted externally to the plunger 136. In an embodiment, the diversion line 154 may have a smaller diameter than diversion passage 152 such that the fluid pressure increases as the hydraulic fluid enters the diversion line 154. Hydraulic fluid flowing into the bore 146 may flow through the diversion passage 152 and the diversion line into the chamber 126.

A check valve 156 may be provided at the junction of the diversion passage 152 and the diversion line 154. The check valve 156 may permit flow of fluid from the diversion passage 152 to diversion lines 154 and prevent flow of fluid from the diversion line 154 to diversion passage 152. In an embodiment, check valve 156 may be disposed such that the pressure surface 145 is positioned between the bore 146 and the check valve 156.

With reference to FIG. 6 the coupler assembly 124 is retracted and may be disconnected from the corresponding fluid coupler. The gate portion 139 may be recessed into the cavity wide portion 118. The gate portion 139 may be sealed from fluid entry by the cavity wide portion 118. Port 149 of the machine circuit line 148 may be sealed by the plunger wide portion 140.

In an embodiment, bore 146, in the plunger 136 not provided with a gate portion 139, may be recessed into the cavity wide portion 118 and may be sealed from fluid entry by the cavity wide portion 118.

With reference to FIG. 7 the coupler assembly 124 is extended and may be connected to the corresponding fluid coupler. The gate portion 139 may be positioned to be in fluid communication with the port 149 of the machine circuit line 148. Fluid may flow from the machine circuit line 148 through port 149 and into the gate portion 139. Hydraulic fluid may flow around the gate portion 139 and into the hollow of plunger 136 through the plurality of bores 146.

In an embodiment, when the gate portion 139 is in fluid communication with machine circuit line 148 the coupler assembly 124 may be at a fully extended position. In an embodiment, the gate portion 139 may have dimension and/or shape which corresponds to the port 149.

In an embodiment with plunger 136 not provided with a gate portion 139, when the coupler assembly 124 is extended the bore 146 may be positioned to be in fluid communication with the port 149 of the machine circuit line 148. Fluid may flow from the machine circuit line 148 through port 149 and into the bore 146. Hydraulic fluid may flow into the hollow of plunger 136 through the bore 146.

In an embodiment, the bore 146 may have dimension and/or shape which corresponds to the port 149. In an embodiment, when the bore 146 is in fluid communication with machine circuit line 148 the coupler assembly 124 may be at a fully extended position A coupling arrangement 110 for fluid coupling a work tool 103 to a machine 101, the coupling arrangement 110 comprising: at least one coupler assembly 124 slideably mounted for coupling a machine fluid circuit and a work tool fluid circuit at a connect position; an actuation fluid circuit 9 arranged to actuate the at least one coupler assembly 124 from a disconnect position to the connect position; a sensor 130 to detect presence of the work tool 103; and a device 10 to actuate a contamination cover 18 on a machine bracket 112, the device 10 comprising: a first transition cylinder 14 mounted on the machine bracket 112 and connected to the contamination cover 18; a transition circuit 16 connected to the first transition cylinder 14 for transmission of hydraulic pressure to the first transition cylinder 14; and a transition sensor 12 coupled to the transition circuit 16 to control the transmission of hydraulic pressure to the first transition cylinder 14, wherein the activation of the transition sensor 12 permits the transmission of hydraulic pressure to drive the first transition cylinder 14 for the transition of the contamination cover 18 from a close to an open position.

In an embodiment, the device 10, comprised in the coupling arrangement 110, may further comprise a second transition cylinder 15. The second transition cylinder 15 may be positioned on the machine bracket 112. The second transition cylinder 15 may be connected to the contamination cover 18. The transition piston rod 19 may be connected to the contamination cover 18. The movement of the transition piston rod 19 of the second transition cylinder 15 in conjunction with the transition piston rod 19 of the first transition cylinder 14 may effect the transition of the contamination cover 18 from the open to the close positions.

With reference to FIG. 2, the operation of the coupling arrangement 110 may be initiated by coupling a machine bracket 112 to a work tool bracket 114. The hydraulic power circuit 135 may be activated to actuate the locking device 134 to lock machine bracket 112 to the work tool bracket 114. The locking device 134 may be actuated to lock the brackets 112, 114 through increased fluid pressure through line X. In an embodiment, the increased fluid pressure may act on the rod side of the locking device 134.

Upon locking of the brackets 112, 114, pressure in the hydraulic lines may increase further. The pressure regulator 158 may be connected to line X. Pressure regulator 158 may open only when the locking pressure in the locking device 134 is higher than a preset value of the pressure regulator 158. In an embodiment, the value is selected from the range of 60 bar-90 bar. In an embodiment, the value is 53 bar. Flow of hydraulic fluid to the bracket switch 130 and the rail circuit 113 may be prevented before the brackets 112, 114 are mechanically locked.

Hydraulic fluid may flow to the bracket switch 130 when the pressure regulator 158 opens to permit fluid flow. Bracket switch 130 may be activated if the work tool bracket 114, carrying a corresponding fluid coupler, is coupled to the machine bracket 112. Activation of the bracket switch 130 may effect the actuation of a valve 160 to permit flow of fluid to the device 10. The valve 160 may be provided between line 24 and line 26.

The fluid may flow through line G to the first transition cylinder 14. In an embodiment, the fluid may flow through lines G to the first and second transition cylinders 14, 15. The fluid may be permitted to flow to line H when the coupling switch 23 may connect lines G and H.

The coupling switch 23 may be in fluid communication simultaneously with lines G and H when the transition rods 19 move the contamination cover 18 to the open position. The transition rods 19 may be in the extracted positions for the coupling switch 23 to be in simultaneous fluid communication with lines G and H.

The fluid in line H may flow to check valve 162.

Check valve 162 may permit fluid to flow into the rail circuit 113 and through rail circuit lines 150 to the chambers 126. Increased flow of fluid in the chambers 126 results in increased fluid pressure therein. The fluid pressure may act on the pressure surfaces 145 of the coupler assemblies 124 effecting extension from the disconnect position to an extended position at which a fluid coupling between the fluid couplers 142 and the corresponding fluid couplers in the work tool bracket 114 is established. The build up of pressure in chamber 126 may not enter the hollow of plunger 136 as a result of the check valve 156 which blocks the flow of fluid from the diversion line 154 to the diversion passage 152.

In an embodiment, check valve 162 may permit fluid to flow through the rail circuit 113 to the piston side of the actuators 128. Increased flow of fluid into the piston side chambers of the actuators 128 may result in increased fluid pressure therein to effect extension of the actuators 128. The actuators 128 may be connected to the coupler assemblies 124 and may effect a corresponding extension of the coupler assemblies 124. The extension of the coupler assemblies 124 through extension of the actuators 128 may be optional or may be in addition to the extension effected by the action of the pressurised fluid on the pressure surface 145.

Extraction of the coupler assemblies 124 through the pressure build up in the chambers 126 and/or extension of the actuators 128, may connect lines A, B, C, D and L through respective lines 148 and ports 149 to the hollows of plungers 136 to allow fluid flow from the machine fluid circuit into the hollow of plunger 136. If the machine fluid circuit is not actuated, fluid inside the hollow of plunger 136 may remain at atmospheric or tank pressure. Upon actuation of the machine fluid circuit the pressure in the lines 148 and the hollow of plunger 136 may increase.

At fluid coupling between the fluid couplers 142 and the corresponding fluid couplers, the gate portions 139 may be in fluid communication with ports 149 allowing fluid to flow through machine circuit lines 148 into the hollow of plunger 136. Fluid may then pass through fluid channels 143 in the fluid couplers 142 to the respective channels in the corresponding fluid couplers.

In an embodiment, at fluid coupling between the fluid couplers 142 and the corresponding fluid couplers, the bores 146 of each plunger 136 may be in fluid communication with ports 149 allowing fluid to flow through machine circuit lines 148 into the hollow of plunger 136. Fluid may then pass through fluid channels 143 in the fluid couplers 142 to the respective channels in the corresponding fluid couplers.

At fluid coupling between the fluid couplers 142 and the corresponding fluid couplers and flow of pressurised fluid through the respective fluid channels, separation forces may be generated which act on the fluid couplers. The separation forces may be countered by the fluid pressure acting on the pressure surface 145 and/or the actuators 128. In an embodiment, pressure in the chamber 126 may be sufficient to generate a force on the pressure surface 145 to maintain fluid coupling between the fluid couplers. In an embodiment, fluid coupling between the fluid couplers may be maintained through the pressure in the actuators 128 and the pressure in the chamber 126 acting on the pressure surface 145.

The separation forces generated may be dependent on the pressure of the fluid in the machine circuit. In an embodiment, an increase in the machine fluid circuit pressure may result in a higher separation force between the fluid couplers. The pressure surface 145 may be provided such that the difference in the ratio between the fluid coupler surfaces and pressure surface 145 is greater than 1 so that force acting on pressure surface 145 is greater than the separation force.

The chamber 126 may be connected to the machine fluid circuit via the check valve 156 mounted in the plunger 136.

If pressure in the machine fluid circuit is higher than the pressure in the chamber 126, the fluid in the hollow of the plunger 136 may be at a higher pressure value and may flow to the chamber 126 where the fluid pressure has a lower pressure value. The fluid at a higher pressure will flow from the hollow of the plunger 136 through the diversion passage 152, the check valve 156 and the diversion line 154 into the chamber 126. The flow of fluid may continue till the pressure in the chamber 126 and pressure in the hollow of the plunger 136 equalise.

As the pressure in the chamber 126 generates a force on the pressure surface 145, the force acting on the pressure surface 145 may be equal to the separation forces generated by the fluid flowing from the hollow of plunger 136 through the fluid channels and which act on the fluid couplers. The equalising of pressures in the chamber 126 and the hollow of plunger 136 may serve to lock the coupler assemblies 124. As all chambers 126 are connected through the rail circuit 113, a higher pressure load in one chamber 126 may be distributed to the other chambers 126, even if the pressures in the hollow of the respective plungers 136 may be at a lower pressure value.

As fluid may not flow from the chamber 126 to the hollow of plunger 136, due to the check valve 156, the pressure in the chamber 126 may remain even when the pressure in the machine fluid circuit drops to a pressure value lower than the pressure value in the chamber 126. The pressure level may be available in the chambers 126 independent of the pressure in the hydraulic lines A, B, C, D and L of the machine circuit. As all chambers 126 are connected through the rail circuit 113, a balanced pressure load may be present to all coupler assemblies 124, even if the machine circuit pressure is lower or absent.

In an embodiment, check vale 162 may be pilot operated to block inflow of fluid having potentially damaging fluid pressures so as to avoid damage to components that may not be designed to withstand a high pressure. The check valve 162 may block high pressure in the rail circuit 113 from reaching the locking device 134.

In an embodiment, a pressure relief valve 164 may connect the rail circuit 113 to machine fluid circuit. The pressure relief valve 164 may be an adjustable pilot operated valve that is mounted to remove excessive pressure peaks generated in the machine fluid circuit that may be transmitted to the chambers 126 through the check valve 156 and the rail circuit 113. The pressure relief valve 164 may have pressure setting that is significantly higher than the maximum pressure tolerable in the chambers 126 and the rail circuit 113 to avoid unintended loss of force needed to maintain fluid coupling. In an embodiment, the pressure relief valve 164 may have pressure setting selected from the range of 390 bar-420 bar. In an embodiment, the pressure setting is 420 bar.

When the machine bracket 112 and work tool bracket 114 are brought in a coupled position the locking device 134 may be activated to lock the components mechanically.

A this stage, the bracket switch 130 and the coupling switch 23 may not be actuated to permit the flow of fluid. The contamination control cover 18 may be in the close position.

At the activation of the locking device 134, line X may be pressurised up to 120 bar max and the cylinder of the locking device 134 may start to retract.

When the pressure in line X reaches a value of 53 bar pressure regulator 158 may open to permit fluid to flow to the bracket switch 130 through line 2. Upon activation the bracket switch 130 may open. Line G may be pressurised at approximately 70 bar. Coupling switch 23 may be activated to connect lines G & H to permit fluid to flow to the rail circuit 113 so that the fluidconnectors in the machine bracket 112 and work tool bracket 114 may start to engage.

If either of the bracket switch 130 or coupling switch 23 fails to be activated to permit flow of fluid the fluidconnector engaging sequence may be stopped.

A method of coupling a work tool 103 to a machine 101, the method comprising providing at least one coupler assembly 124 slideably mounted for coupling a machine fluid circuit and a work tool fluid circuit; arranging an actuation fluid circuit 9 to actuate the at least one coupler assembly 124 from a disconnect position to the connect position; arranging a sensor 130 to detect presence of the work tool 103; activating the sensor 130 when the work tool 103 is mounted to a machine bracket 112; transmitting a hydraulic pressure to a transition circuit 16 connected to a first transition cylinder 14, the first transition cylinder 14 being mounted on the machine bracket 112 and being connected to the contamination cover 18; and activating a first transition sensor 12 coupled to the transition circuit 16, wherein the activation of the transition sensor 12 permits the transmission of hydraulic pressure to drive the first transition cylinder 14 for the transition of the contamination cover 18 from a close to an open position.

With reference to FIG. 2, operation of the coupling arrangement 110 to decouple machine bracket 112 from the work tool bracket 114 may be initiated by relieving pressure in the chambers 126 and the rail circuit line 150 through the rail circuit 113.

In an embodiment, a drain circuit 176 for the rail circuit 113 may be provided through a normally-open drainage switch 166 and primary drainage check valves 168, 170. Drainage switch 166 may close to block the drain function, only when the chambers 126 and the rail circuit lines 150 are pressurised. The drainage switch 166 and primary drainage check valves 168, 170 may be provided on hydraulic return lines leading from the rail circuit 113 to the machine fluid circuit.

A drain circuit 176 for the rail circuit 113 may comprise a return fluid line 178 connecting the rail circuit 113 to a machine fluid circuit; the drainage switch 166 provided on the return fluid line 178; and at least one check valve 168, 170 provided on the return fluid line 178 upstream of the drainage switch 166 to prevent flow of the return fluid towards the drainage switch 166.

In an embodiment, the drain circuit 176 may include a branch return fluid line 180. The return fluid line 178 and the branch return fluid line 180 may connect the rail circuit 113 to two fluid lines A, D of the machine fluid circuit. The check valves 160, 170 may be separately positioned on the return fluid line 178 and the branch return fluid line 180. The primary drainage check valves 168, 170 may be connected to the return fluid line such that when one of the lines is depressurized the check valves 168, 170 may allow return fluid to flow back to the tank. The flow of the return fluid may be enabled by the depressurization in the lines. The return fluid may always flow into the lines which has been depressurized when the drainage switch is open.

In an embodiment primary drainage check valves 168, 170 may be connected to lines A and D, wherein either one of these lines may be depressurized to allow return fluid to flow back to the tank. The return fluid may consist of a fluid volume in the piston side of the actuators 128 and in the chambers 126.

The coupling arrangement 110 for decoupling the work tool 103 from the machine 101 may comprise a plurality of coupler assemblies 124 slideably mounted in a plurality of cavities 116, the coupler assemblies 124 partitioning the cavities 116 to form chambers 126; a rail circuit 113 connecting the chambers 126; and the drain circuit 176.

A method of reducing rail circuit 113 pressure for decoupling a work tool 103 from a machine 1 may comprise the steps of reducing pressure in chambers 126 and rail circuit lines 150 connecting the chambers 126 to the rail circuit 113 to open a drainage switch 166 positioned on a return fluid line 178; and reducing pressure in a machine fluid circuit line A, D connected to the return fluid line 178 to enable flow of return fluid from the rail circuit 113 to the machine fluid circuit.

In an embodiment, further primary drainage check valves may be provided which are connected to the other hydraulic lines.

Pressure in line X may be relieved while line Y may be pressurised though the hydraulic power circuit 135. Fluid from line Y may flow into the rod side of the actuators 128. Increase in pressure in the rod side and the reduction of pressure in the piston side may effect a retraction of the actuators 128. As the actuators 128 are connected to the coupler assemblies 124, the coupler assemblies 124 may be correspondingly retracted and disconnected from fluid coupling. The full retraction of the actuators 128 may correspondingly effect complete retraction of the coupler assemblies 124 into the machine bracket 112.

A secondary drain circuit may consist of check valve 162 and secondary drainage check valve 172. The valves 162 and 172 may allow fluid to flow back to the tank through line X but only if line Y is pressurised. The return fluid may consist of a fluid volume in the piston side of the actuators 128 and in the chambers 126.

Switch 132 may detect the position of the actuators 128. Switch 132 may be normally closed and may block flow of fluid from the hydraulic power circuit 135 through line Y to locking device 134. At complete retraction of the actuators 128 the switch 132 may effect the actuation of the valve 173 to permit flow of fluid from the hydraulic power circuit 35 to the piston side of the locking device 134 to unlock the brackets 112, 114. This is a safety measure to avoid unintended operation of the locking device 134 if the coupler assemblies 124 have not been retracted completely into the machine bracket 112.

A relief valve 174 may be provided in the hydraulic line connecting line Y and the rod sides of the actuators 128 to avoid any unintended drift of the actuators 128 in the disconnected position. The relief valve 174 may be pilot operated. The fluid in the rod side of the actuators 128 may be trapped unless chambers 126 and the lines 150 are pressurized to such level as to pressure regulator 158.

The skilled person would appreciate that foregoing embodiments may be modified to obtain the apparatus of the present disclosure.

INDUSTRIAL APPLICABILITY

This disclosure describes a device 10 and a coupling arrangement 110 for coupling a machine hydraulic fluid circuit to a work tool hydraulic fluid circuit.

In a machine 101, work tools 103 may be used for handling heavy materials. Work tools 103 may demolish, drill, dig, plow, cut, grab and/or carry heavy materials which may include sand, stone, metal, and more. Work tools 103 may be coupled to and powered by machines 101, in particular mobile host machines. The machine 101 may be provided with transmissions, hydraulic equipment, booms 102 and/or sticks for driving the work tool 103. Work tool operations may be controlled by the operator via an operating panel in the cab of the machine 101.

The device 10 may control the movement of the contamination cover 18 between the open and the close positions. The contamination cover 18 may shield the fluidconnectors disposed in a machine bracket 112 from contaminants. However, at coupling of a work tool 103 that may have fluidconnectors to a machine 101, the contamination cover 18 may be moved from the close position to the open position. The device 10 may move the contamination cover 18 from the close position to the open position to enable the fluidconnectors disposed in the machine bracket 112 and the work tool bracket 114 to connect.

The device 10 may move the contamination cover 18 through the abutment of the work tool bracket 114 with a transition sensor 12.

The device 10 may comprise a coupling switch 23 as a part of the connecting control of the coupling arrangement 110 for coupling the machine 101 to the work tools 103. The device 10 may permit flow of fluid to the actuation fluid circuit 9 only when the contamination cover 18 is at the open position. This check occurs before any fluid is directed to the rail circuit 113. The coupling switch 23 may be provided in the first and/or second transition cylinder 14, 15. If no fluid flow through the coupling switch 23 occurs the connecting process between the work tool bracket 114 and the machine bracket 112 may be stopped.

Hydraulic fluid may first flow through the bracket switch 130 and the coupling switch 23 before reaching the common rail 113 for the engagement of the fluidconnectors.

The coupling arrangement 110 may have at least one hollow plunger 136 provided with a check valve 156. The hollow plunger 136 may connect the machine fluid circuit to the rail fluid circuit through diversion passage 152 and diversion line 154. The fluid pressure in the machine fluid circuit may be used to retain the fluid coupling of the fluid couplers. The check valve 156 may restrict the fluid flow from the rail fluid circuit to the machine fluid circuit.

In operation of the coupling arrangement 110, pressure in the chambers 126 may be provided from either the rail fluid circuit, during the connection process, or the machine fluid circuit, during operation of the work tool. Check valves 156 and 162 may allow pressure to build up in the chambers 126. The prevailing pressure value in the chambers 126 may be the higher of the pressure values of the machine fluid circuit or the rail fluid circuit. This pressure in the chambers 126 may remain even if the pressure source is no longer available. Pressure relief valve 164 may protect the chambers 126, the rail circuit line 150 and the rail circuit 113 against damage as a result of excessive pressure.

The coupling arrangement 110 may have at least one hollow plunger 136 provided with a gate portion 139 having a plurality of bores 146 or a bore 146. When the coupler assemblies 124 are retracted to a disconnect position, the chambers 126 may be sealed from the hydraulic lines of the machine fluid circuit. At disconnection, the coupler assembly 124 may not be actuated unintentionally as a result of pressure build up in the hydraulic lines of the machine fluid circuit when fluid coupling has not yet been established.

The coupling arrangement 110 may have a rail fluid circuit to ensure a balanced load on the coupler assemblies 124. All chambers 126 may be connected through the rail fluid circuit to allow the highest pressure in any of the hydraulic lines of the machine fluid circuit or of the rail fluid circuit to generate the load required to retain fluid coupling between the fluid couplers.

The coupling arrangement 110 may have a bracket switch 130 to detect whether the work tool bracket 114 carries a corresponding fluid coupler. Bracket switch 130 may not permit fluid pressurisation of the rail fluid circuit when a work tool bracket 114 carrying a corresponding fluid coupler is not detected. The bracket switch 130 may avoid inefficient coupling present in devices wherein fluid connections are established simultaneously at mechanical coupling of the machine bracket and the work tool bracket.

The coupling arrangement 110 may have a switch 132 to detect whether the actuators 128 are fully retracted. The activation of switch 132 determines whether the locking device 134 may be actuated to unlock the brackets 112, 114 without the risk of potential damage to the fluid couplers and/or couplers assemblies 124.

The locking device 134 may be moved to the unlocked position when switch 132 may be activated to the open position. The machine bracket 112 and the work tool bracket 114 may be disengaged when the locking device 134 is in then unlocked position. The line X may be depressurised and line Y may be pressurised. The shuttle valve 20 may be actuated as the higher hydraulic pressure acting thereon switches between the lines. Upon disengagement of the work tool bracket 114 the pressing engagement on the transition sensor 12 is not present causing then valve 30 to close. With the transition sensor 12 in the closed position hydraulic pressure in the transition circuit 16 may not be subject to the pressure from the hydraulic power circuit 135. The fluid in the transition circuit 16 may flow into line 28 as the biasing element 17 moves the contamination cover 18 from the open position to the close position.

The industrial applicability of the device 10 and the coupling arrangement 110 as described herein will have been readily appreciated from the foregoing discussion.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein.

The disclosures in European Patent Application No. 11180408.4 from which this application claims priority are incorporated herein by reference.

Where technical features mentioned in any claim are followed by references signs, the reference signs have been included for the sole purpose of increasing the intelligibility of the claims and accordingly, neither the reference signs nor their absence have any limiting effect on the technical features as described above or on the scope of any claim elements.

One skilled in the art will realise the disclosure may be embodied in other specific forms without departing from the disclosure or essential characteristics thereof. The foregoing embodiments are therefore to be considered in all respects illustrative rather than limiting of the disclosure described herein. Scope of the invention is thus indicated by the appended claims, rather than the foregoing description, and all changes that come within the meaning and range of equivalence of the claims are therefore intended to be embraced therein.

The invention claimed is:

1. A device to actuate a contamination cover on a machine bracket, the device comprising:

a first transition cylinder mounted on the machine bracket and connected to the contamination cover;

a transition circuit connected to the first transition cylinder for transmission of hydraulic pressure to the first transition cylinder;

a transition sensor coupled to the transition circuit to control the transmission of hydraulic pressure to the first transition cylinder; and a coupling switch provided in the first transition cylinder for transmission of hydraulic pressure through an actuation fluid circuit, wherein the activation of the transition sensor permits the transmission of hydraulic pressure to drive the first transition cylinder for transition of the contamination cover from a close to an open position.

2. The device of claim 1 further comprising a second transition cylinder mounted on the machine bracket, the second transition cylinder being connected to the contamination cover and being hydraulically connected to the transition sensor.

3. The device of claim 2 further comprising a shuttle valve connected between the transition circuit and a plurality of hydraulic lines.

4. The device of claim 3 wherein the plurality of hydraulic lines comprise a bypass circuit.

5. The device of claim 4 wherein the bypass circuit is connected to first and second hydraulic lines, the first and second hydraulic lines being further connected to a locking device.

6. The device of claim 3 wherein the plurality of hydraulic lines comprise a first hydraulic line and a second hydraulic line.

7. The device claim 6 wherein a hydraulic power circuit is connected to the plurality of hydraulic lines to provide hydraulic pressure to at least one of the first transition cylinder and the second transition cylinder.

8. The device of claim 1 wherein the transition sensor comprises a mechanical switch coupled to a valve provided in the transition circuit.

9. The device of claim 1, wherein the actuation fluid circuit is configured to fluidly couple a machine fluid circuit and a work tool fluid circuit.

10. A method of actuating a contamination cover on a machine bracket, the method comprising the steps of:

activating a transition sensor coupled to a transition circuit that is connected to a transition cylinder, the transition cylinder being mounted on the machine bracket and being connected to the contamination cover;

transmitting hydraulic pressure to the transition circuit; and activating a coupling switch provided in the transition cylinder, wherein the activation of the transition sensor permits transmission of hydraulic pressure to drive the transition cylinder for a transition of the contamination cover from a close to an open position, and wherein the activation of the coupling switch permits transmission of hydraulic pressure through an actuation fluid circuit fluidly coupled to a coupling arrangement.

11. The method of claim 10 further comprises a step of pressurising a hydraulic power circuit that includes pressurising alternatively a first hydraulic line and a second hydraulic line, wherein the first hydraulic line and the second hydraulic line are connected to the hydraulic power circuit.

12. The method of claim 11 further comprises a step of actuating a shuttle valve connected between the hydraulic power circuit and the transition circuit for selecting a hydraulic line from the first hydraulic line and the second hydraulic line having a higher hydraulic pressure for transmission of hydraulic pressure to the transition sensor.

13. The method of claim 12 wherein the activation of the coupling switch includes connecting the coupling switch to the actuation fluid circuit and transmitting hydraulic pressure through the actuation fluid circuit between a machine fluid circuit of the coupling arrangement and a work tool fluid circuit.

14. A coupling arrangement for fluid coupling a work tool to a machine, the coupling arrangement comprising:

at least one coupler assembly slideably mounted for coupling a machine fluid circuit and a work tool fluid circuit at a connect position;

an actuation fluid circuit arranged to actuate the at least one coupler assembly from a disconnect position to the connect position;

a sensor to detect presence of the work tool; and a device to actuate a contamination cover on a machine bracket, the device comprising:

a transition cylinder mounted on the machine bracket and connected to the contamination cover;

a transition circuit connected to the transition cylinder for transmission of hydraulic pressure to the transition cylinder;

a coupling switch provided in the transition cylinder for transmission of hydraulic pressure through the actuation fluid circuit; and a transition sensor coupled to the transition circuit to control the transmission of hydraulic pressure to the transition cylinder, wherein the activation of the transition sensor permits transmission of hydraulic pressure to drive the transition cylinder for transition of the contamination cover from a close to an open position.

15. A method of coupling a work tool to a machine, the method comprising:

providing at least one coupler assembly slideably mounted for coupling a machine fluid circuit and a work tool fluid circuit;

arranging an actuation fluid circuit to actuate the at least one coupler assembly from a disconnect position to the connect position;

arranging a sensor to detect presence of the work tool;

activating the sensor when the work tool is mounted to a machine bracket;

activating a transition sensor coupled to a transition circuit that is connected to a transition cylinder, the transition cylinder being mounted on the machine bracket and being connected to a contamination cover;

transmitting hydraulic pressure to the transition circuit; and activating a coupling switch provided in the transition cylinder, wherein the activation of the transition sensor permits transmission of hydraulic pressure to drive the transition cylinder for transition of the contamination cover from a close to an open position, and wherein the activation of the coupling switch permits transmission of hydraulic pressure through an actuation fluid circuit fluidly coupled to a coupling arrangement that includes the at least one coupler assembly.

* * * * *